US006311396B1

(12) United States Patent
Alsaifi

(10) Patent No.: US 6,311,396 B1
(45) Date of Patent: Nov. 6, 2001

(54) DISPOSABLE STRAIGHT RAZOR

(76) Inventor: Saad Mobarak Alsaifi, P.O. Box 332, Al Fentas (KW)

( * ) Notice: Subject to any disclaimer, the term of this patent is extended or adjusted under 35 U.S.C. 154(b) by 0 days.

(21) Appl. No.: 09/484,893

(22) Filed: Jan. 18, 2000

(51) Int. Cl.[7] ..... B26B 21/06
(52) U.S. Cl. ..... 30/55; 30/53
(58) Field of Search ..... 30/53, 59, 50, 30/151, 286

(56) References Cited

U.S. PATENT DOCUMENTS 4,622,742 * 11/1986 Lee ..... 30/55
4,920,644 * 5/1990 LaGattuta ..... 30/53
5,649,364 7/1997 Ilanlou .
6,082,007 * 7/2000 Andrews ..... 30/53 X

FOREIGN PATENT DOCUMENTS

2704797 * 11/1994 (FR) ..... 30/53

* cited by examiner

*Primary Examiner*—Douglas D. Watts
(74) *Attorney, Agent, or Firm*—Thomas R. Vigil

(57) ABSTRACT

The disposable straight razor comprises: an elongate body; a razor blade mounted in the body; the body being molded about the razor blade; the razor blade extending outwardly from the body a distance of from approximately 0.05 mm to approximately 4 mm; and a cover for the body and the razor blade which extends completely over the body and the razor blade.

4 Claims, 4 Drawing Sheets

DISPOSABLE STRAIGHT RAZOR

BACKGROUND OF THE INVENTION

1. Field of the Invention.

The present invention relates to a disposable shaving device with razor blade of the type used in barbershops and by hairdressers. More specifically, the present invention relates to a disposable straight razor having a cover and a razor blade extending outwardly from a body of the straight razor a distance between approximately 0.5 and 4 mm.

2. Description of the Prior art

Presently available shaving devices and razor blades used therein typically include a body and a razor blade which is periodically changed while keeping the body of the device for further use.

The shaving device of this type is exposed to various contamination factors during the process of changing blades such as may result from any wounds that might have taken place during the prior shaving use.

This can lead to the contamination of the shaving device per se, which in turn can cause infection and may cause the transfer of different diseases from one infected person to another healthy person. Infections are now very serious and include skin diseases in addition to the more serious diseases, which are carried by skin and blood, such as staphococus, hepatitis Virus B and C and AIDS.

Heretofore, several disposable straight razors have been proposed and examples of same are disclosed in the following U.S. Patents:

| U.S. Pat. No. | Patentee |
|---|---|
| 4,622,742 | Lee |
| 4,920,644 | LaGattuta |
| 5,649,364 | Ilanlou |

SUMMARY OF THE INVENTION

An object or feature of the present invention is to provide a disposable shaving device with razor blade, such as a straight razor, which is lightweight and easy to use in barber shops and by hairdressers.

Another object or feature of the present invention is to provide a disposable device with razor blade for shaving which has a high degree of safety to ensure non transmission of diseases and microbes from one infected person to another healthy person while at the same time providing a high performance razor blade useable in an easy and safe manner.

Still another object or feature of the present invention is to provide a shaving device with a razor blade that does not need razor blade replacement or changing and accordingly does not need to be touched by the user and thus preventing infections from being transmitted to the user or others.

According to the teachings of the present invention there is provided a disposable straight razor comprising: an elongate body; a razor blade mounted in the body; the body being molded about the razor blade; the razor blade extending outwardly from the body a distance of from approximately 0.05 mm to approximately 4 mm; and a cover for the body and the razor blade which extends completely over the body and the razor blade.

DESCRIPTION OF THE PREFERRED EMBODIMENT(S)

Figure 1:
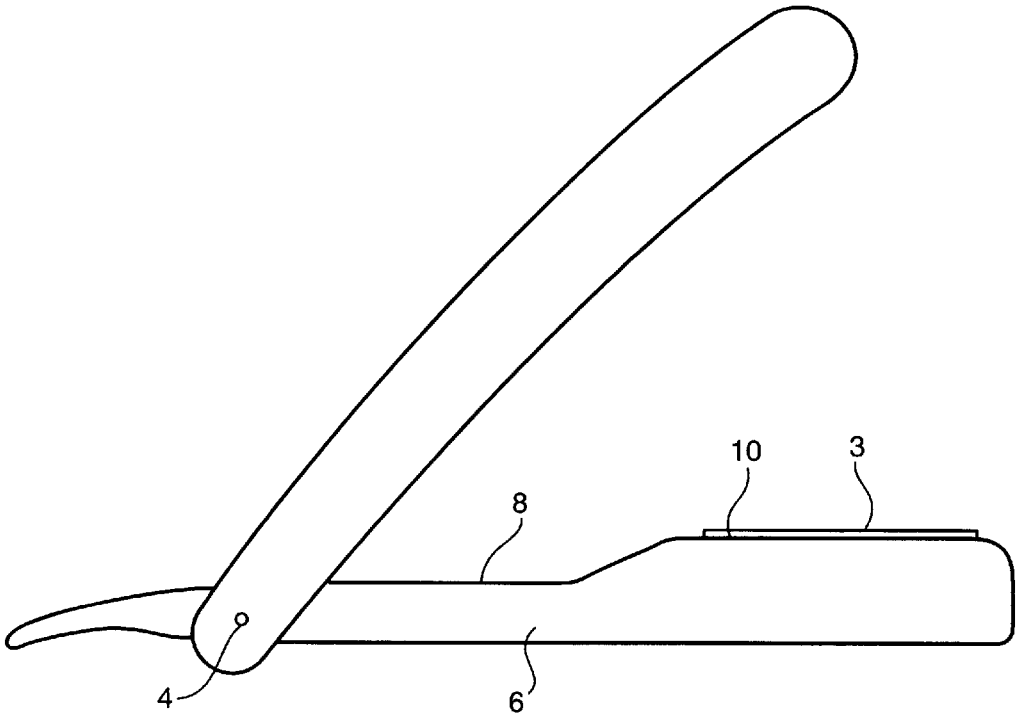
FIG. 1 is a plan view of one embodiment of the straight razor of the present invention.

FIG. 1 is a plan view showing the straight razor 1 of the present invention. The straight razor 1 comprises two sections. The first section is a body 6 of the straight razor 1 having a metal razor blade 3 fixed therein, such as by having the body 6 molded around the razor blade 3. The second section comprises a cover 2 for the body 6 and razor blade 3 and also serves as a balance tool for the user's hand. The two sections are connected by a screw 4 which can be made from any suitable material, e.g. a plastic or a metal.

It should be noted that the surface 8 of the body 6 of the straight razor 1 has a rough texture or serrations and is not smooth in order to prevent sliding of the straight razor 1 in the hand of a user and allow maximum control of the straight razor during use to get the best shaving result in the shortest possible time.

The razor blade 3 is fixed in the body 6 such as by molding a plastic body 6 about the razor blade 3 thereby to provide a unitary one piece body 6 and razor blade 3 so that the razor blade 3 cannot be detached or removed or replaced.

According to one teaching of the present invention, the razor blade 3 projects above an edge 10 of the body 6 a distance of from approximately 0.5 mm to approximately 4 mm.

The cover 2 can be pivoted about the screw 4 to cover the razor blade 3 and body 6 to facilitate the use of the straight razor 1. The cover 2 may have any shape other than the shape shown in FIG. 1, e.g. one of the shapes 11, 12 or 13 shown in FIG. 2 or be a separate cover as shown in FIGS. 3 and 4.

Figure 2:
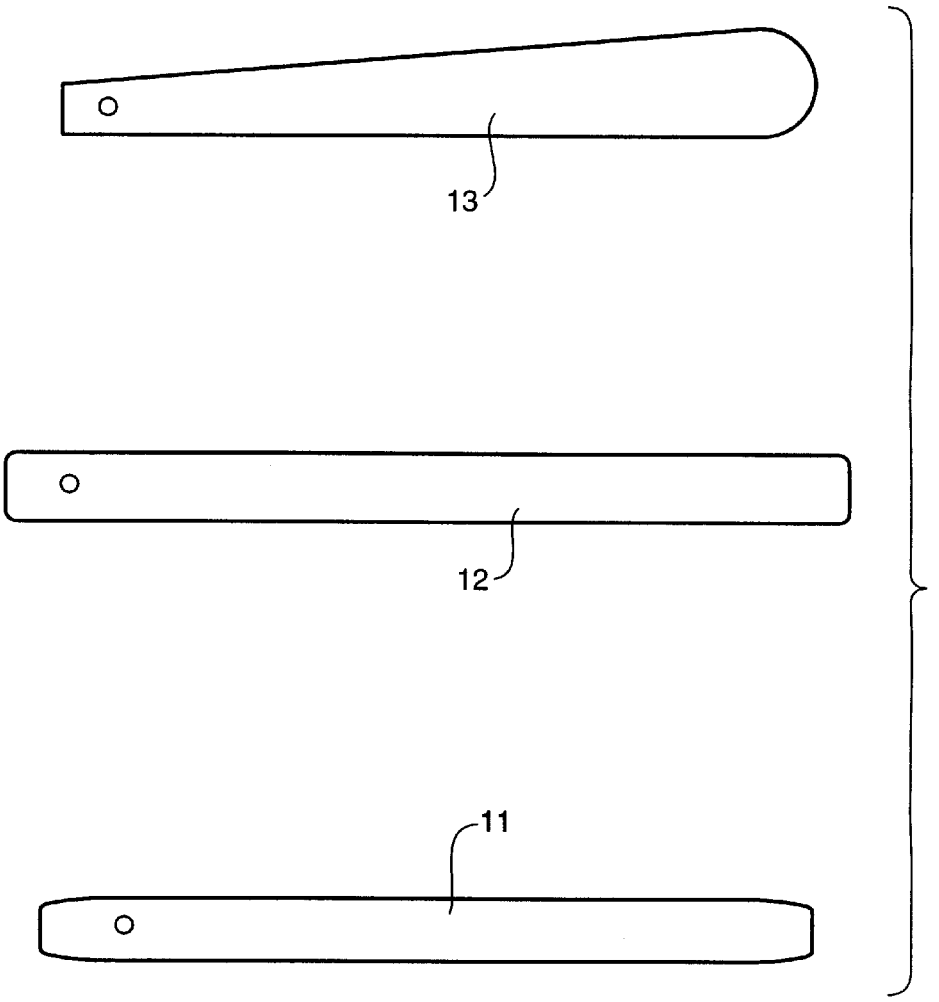
FIG. 2 illustrates three shapes of the cover or handle extension for the straight razor shown in FIG. 1.

FIG. 2 illustrates three shapes 11, 12 or 13 of the cover 2 which can also form part of a handle and which can be grasped to facilitate handling of the straight razor and provide a more attractive cover or handle 2. However, it will be noted that any desirable shape can be used for the cover 2.

Figure 3:
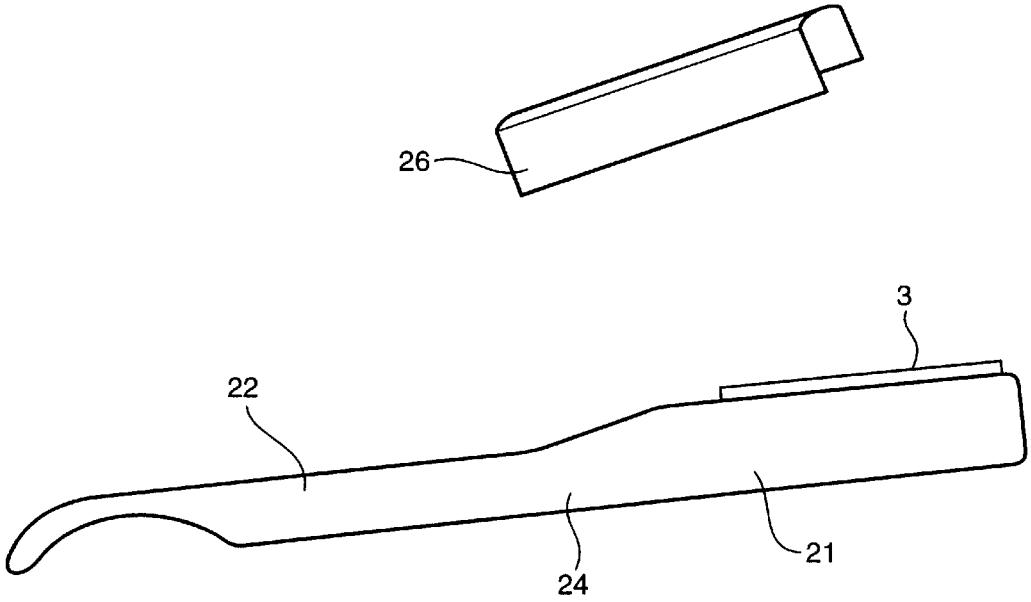
FIG. 3 is a plan view of another embodiment of the straight razor of the present invention.

FIG. 3 illustrates another embodiment of a straight razor 21 of the present invention. In this embodiment, a curved razor handle 22 is integral with a body 24 having a razor blade 3 mounted in the body 24. In this embodiment, a separate, plastic, elongate, inverted U-shaped cover 26 is provided which is not connected to the body 24. Here the straight razor 21 and the razor blade 3 mounted in the body 22 of the straight razor 21 are one simple piece and easy to handle and use with a disposable plastic cover 26.

Figure 4:
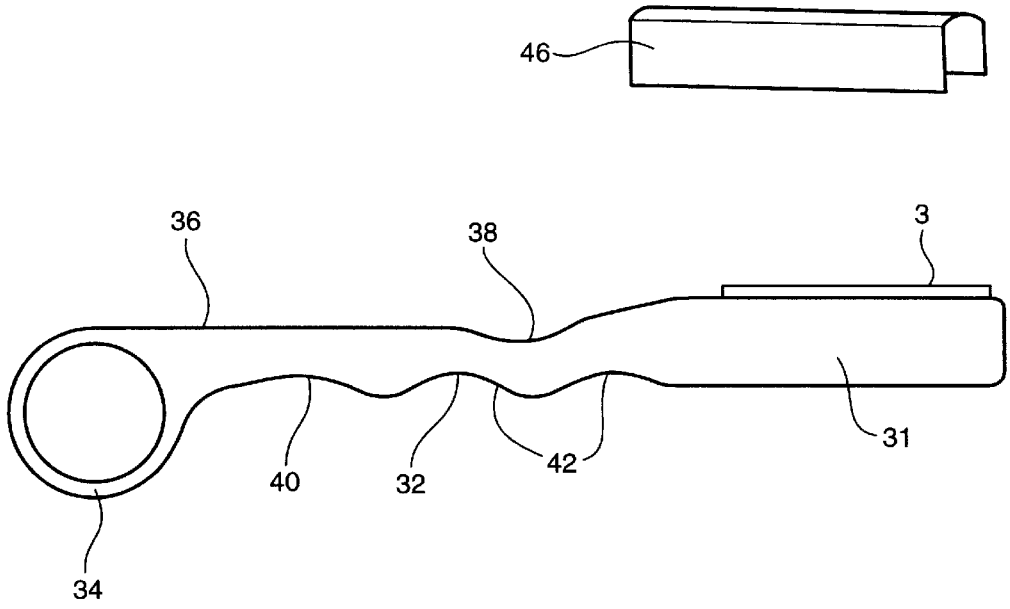
FIG. 4 is a plan view of still another embodiment of the straight razor of the present invention.

FIG. 4 illustrates still another embodiment of a straight razor 31 having a body 32 constructed according to the teachings of the present invention. The straight razor 31 represents a slight variation of the straight razor 21 shown in FIG. 3. In this respect, the variation resides in the shape of the body 32 of the straight razor 31 which has a ring shaped handle portion 34 and an upper edge 36 having the razor blade 3 mounted therein and having a notch 38 for receiving a finger or thumb. Also, a lower edge 40 of the body 32 has finger receiving notches 42 for facilitating gripping of the body 32 and handle portion 34. The razor blade 3 is identical to the blade 3 shown in FIG. 3 and the simple plastic cover 46 is identical to the cover 26 shown in FIG. 3.

The straight razor 1, 21 or 31 can be made from different materials e.g., plastic, stainless steel, aluminum, wood etc. However, in one preferred embodiment of the straight razor of the present invention the body 6, 22 or 32 is made from plastic as it is cheap, light weight and easy to handle.

In the manufacture of the straight razor 1, 21 or 31, a mold having the required shape for the body 6,22 or 32 is made and plastic is injected into the mold. It should be noted that injection of the plastic is made after first fixing the razor blade 3 to project out from an edge of the body 6, 22 or 32 to be molded by the distance specified above, namely 0.5 to 4 mm and preferably 1 to 2 mm so that the razor 3 forms part of the one piece body 6, 22 or 32 whereby the razor blade 3 cannot be removed from the straight razor 1, 21 or 31.

From the foregoing description, it will be understood that the disposable straight razors 1, 21 or 31 of the present invention have a number of advantages, some of which have been described above and others of which are inherent in the invention.

Also, it will be understood that modifications can be made to the disposable straight razors 1, 21 or 31 of the present invention without departing from the teachings of the invention.

Accordingly, the scope of the invention is only to be limited as necessitated by the accompanying claims.

I claim:

1. A disposable straight razor comprising: an elongate body; a razor blade mounted in said body; said body being molded about said razor blade; said razor blade extending outwardly from said body a distance of from approximately 1 mm to approximately 2 mm; a cover for said body and said razor blade which extends completely over said body and said razor blade; said body including a handle portion which has a curved end; said cover being pivotally connected to said handle portion of said body; said cover having an elongate slot with a width sufficient to cover the razor blade and body portion in which said razor blade is mounted; a surface of said body having one of a rough texture or serrations to prevent sliding of said body in the hand of the user to provide for maximum control of the straight razor during use; and, said body being molded around said razor blade to provide a one piece straight razor with a pivotally connected, handle extension forming, plastic cover.

2. A disposable straight razor comprising: an elongate body; a razor blade mounted in said body; said body being molded about said razor blade; said razor blade extending outwardly from said body a distance of from approximately 1 mm to approximately 2 mm; said body including a handle portion which has one of a curved end or a free end in the shape of a ring for receiving a finger; a cover for said body and said razor blade which extends completely over said body and said razor blade; a surface of said body having one of a rough texture or serrations to prevent sliding of body in the hand of the user to provide for maximum control of the straight razor during use; said cover being a separate, plastic, elongate, inverted U-shaped cover; and, said body being molded around said razor blade to provide a one piece straight razor together with a separate plastic cover.

3. The disposable straight razor of claim 2 wherein said body has at least one curved finger or thumb receiving notch on a side edge of said body mounting said razor blade.

4. The disposable straight razor of claim 2 wherein said body has at least one curved finger receiving notch on a side edge of said body opposite a side edge mounting said razor blade.

* * * * *

UNITED STATES PATENT AND TRADEMARK OFFICE

CERTIFICATE OF CORRECTION

PATENT NO. : 6,311,396 B1
DATED : November 6, 2001
INVENTOR(S) : Saad Mobarak Alsaifi It is certified that error appears in the above-identified patent and that said Letters Patent is hereby corrected as shown below:

Column 4,
Line 19, after "of" insert -- said --.

Signed and Sealed this

Seventeenth Day of September, 2002

*Attest:*

*Attesting Officer*

JAMES E. ROGAN
*Director of the United States Patent and Trademark Office*